US005862918A

United States Patent [19]

Jaspers

[11] Patent Number: 5,862,918

[45] Date of Patent: Jan. 26, 1999

[54] TRANSPORT CONTAINER FOR RELAYS

[75] Inventor: Michael Jaspers, Otterstadt, Germany

[73] Assignee: Siemens Aktiengesellschaft, Munich, Germany

[21] Appl. No.: 925,673

[22] Filed: Sep. 9, 1997

[30] Foreign Application Priority Data

Sep. 27, 1996 [DE] Germany ..... 296 16 895.5

[51] Int. Cl.[6] ..... B65D 85/86

[52] U.S. Cl. ..... 206/718; 206/443; 206/499

[58] Field of Search ..... 206/307, 308.1, 206/308.2, 308.3, 387.1, 387.11, 701, 718, 722, 723, 443, 499

[56] References Cited

U.S. PATENT DOCUMENTS

| | | | |
|---|---|---|---|
| 4,519,893 | 5/1985 | Olas | 206/308.3 |
| 4,767,004 | 8/1988 | Ishihara et al. | 206/718 |
| 4,838,422 | 6/1989 | Gregerson | 206/308.3 |
| 5,450,952 | 9/1995 | Funawatari et al. | 206/308.3 |
| 5,509,574 | 4/1996 | Lenz et al. | 206/718 |

*Primary Examiner*—Jim Foster
*Attorney, Agent, or Firm*—Hill & Simpson

[57] ABSTRACT

A transport container serves to contain relays arranged in bar-shaped magazines, whereby the magazines respectively comprise a continuous hollow space with end openings for inserting the relays. The transport container is fashioned as a cartridge with a basically cuboidal shape, open toward the upper side, whose interior space corresponds to the length and width of a magazine and whose height corresponds to a predetermined number of magazines stacked one on top of the other.

23 Claims, 2 Drawing Sheets

TRANSPORT CONTAINER FOR RELAYS

FIELD OF THE INVENTION

The present invention is related to a transport container for relays arranged in bar-shaped magazines, whereby the magazines respectively comprise a continuous hollow space with openings at the frontal side for inserting the relays.

BACKGROUND OF THE INVENTION

It is customary to pack relays in more or less prism-shaped bar magazines, whereby the walls of the respective magazine are matched roughly to the outer contour of the relay. The hollow bar magazines include openings only on the front sides, for the insertion of the relays. After filling the magazine with the predetermined number of relays, the openings are usually sealed with an adhesive strip or the like. Moreover, for transport, it is customary to pack a larger number of these magazines in cartons. The cartons are then sealed with adhesive strips and the like. Upon receipt, the cartons are then opened for further processing. The magazines are removed individually, are opened at their front sides and are individually placed in automatic placement machines, and the relays are then pushed out of the magazines with corresponding apparatuses before being placed on circuit boards or installed in other devices.

SUMMARY OF THE INVENTION

The goal of the present invention is to create a transport container for such bar magazines of relays with which handling is simplified during packing and removal, but a good securing of position is nonetheless ensured for the transporting of the relays.

According to the invention, the transport container of the present invention is formed by a basically cuboidal cartridge open toward the top side, whose interior space corresponds to the length and width of a magazine and whose height corresponds to a predetermined number of magazines stacked one over the other.

In accordance with the present invention, a transport container for relays disposed in elongated bar-shaped magazines is provided. Each of the magazines has an interior hollow space for accommodating the relays and open ends in which the relays can be inserted and removed. The present invention provides a cartridge for accommodating a plurality of relays stacked lengthwise one on top of the other. The cartridges generally have a cuboid shape with an open upper side or top for inserting the magazines and a closed bottom. The cartridge also includes two opposing end wall structures. The cartridge and magazines are sized so the magazines lay inside the interior space of the cartridge and so that the open ends of the magazines engage the end wall structures of the cartridge. In this manner, the end wall structures of the cartridge prevent the relays from being released from the magazines while the magazines are disposed inside the cartridge.

In an embodiment, the present invention provides a transport system for relays that include a plurality of the elongated bar-shaped magazines disposed in one of the cartridges. In yet another embodiment, the present invention provides a transport system for relays that include a plurality of elongated bar-shaped magazines filled with relays, disposed inside a plurality of cartridges, all of which are disposed inside a movable transport vehicle that comprises a plurality of compartments, each of which accommodates a plurality of cartridges.

Due to the arrangement of the magazines in a cartridge adapted precisely in length and width, known as a quiver or tubular holder, it is no longer required to seal each individual magazine at the open ends, since the end walls of the cartridge take over the securing of the relays in the magazines. Only a simple securing of the magazine stack in the form of an adhesive strip or the like at the open upper side of the cartridge is required.

The inventive cartridge can be made of various materials. The use of a plastic or similar material, in which electrostatic charges are avoided, is particularly advantageous. Due to the plastic, the cartridge receives a very low weight and a sufficient stability is achieved despite thin walls. Moreover, the longitudinal side walls of the cartridge can be cut approximately in a U shape in the center region, so that the magazines are essentially held only at their ends between U-shaped walls of the cartridges. This yields an additional savings of material and weight. In the otherwise sealed base region, small openings can be provided so that the lowest magazine can be pushed out in case it gets jammed.

The cartridge preferably consists of two half shells molded from plastic, which are connected to one another at three rims, i.e. at the base and at the two end walls, e.g. by gluing.

BRIEF DESCRIPTION OF THE DRAWINGS

In the following, the invention is explained in more detail in relation to an exemplary embodiment based on the drawing. In the drawing.

It should be understood that the drawings are not necessarily to scale and that the embodiments are sometimes illustrated by diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
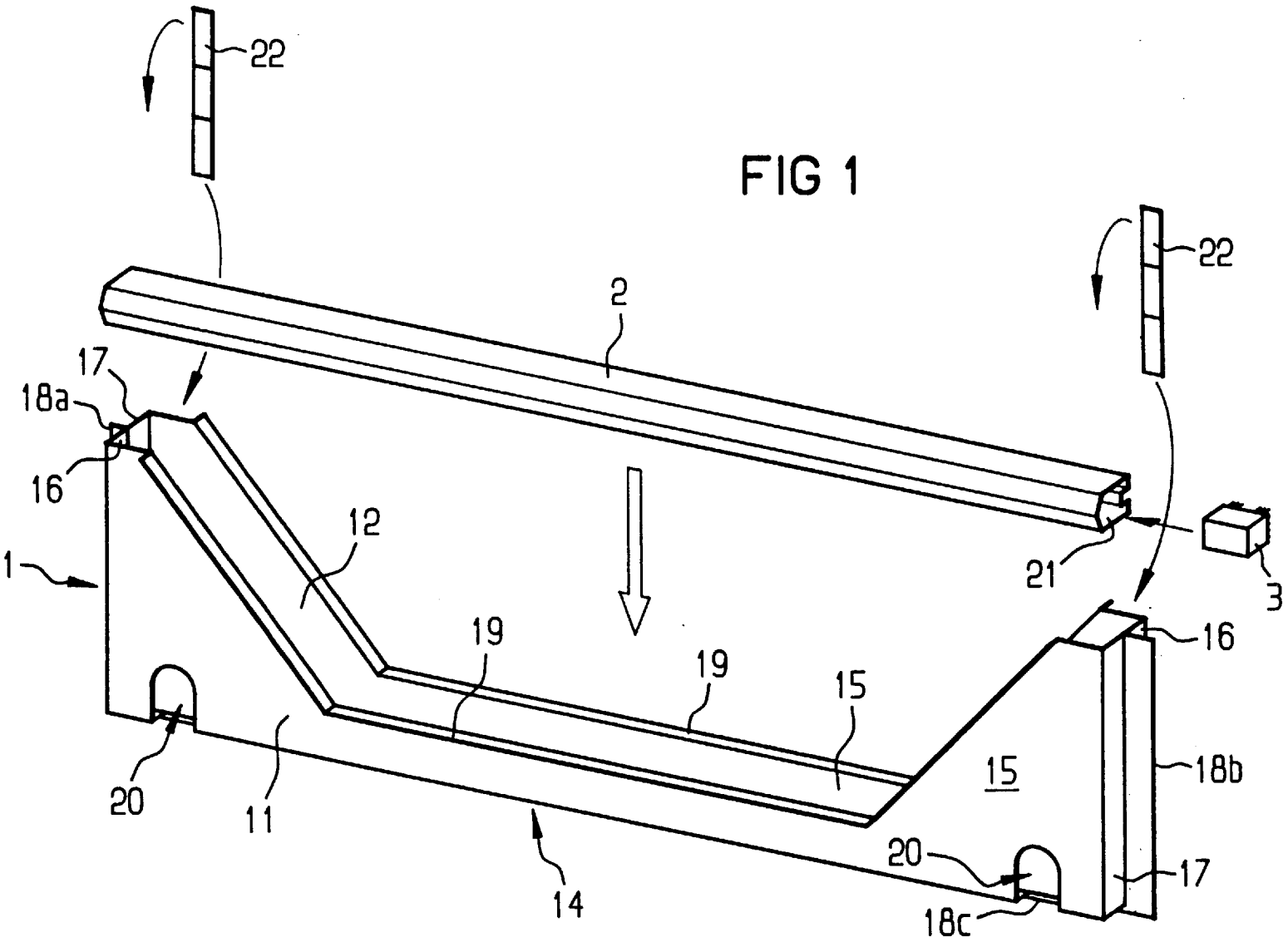
FIG. 1 illustrates a cartridge constructed in accordance with the present invention and with a bar magazine and with a relay, for the illustration of the assembly process.

FIG. 1 illustrates a perspective view of a transport cartridge 1 that accepts bar magazines 2 in which miniature relays 3 are packed by insertion.

Figure 2:
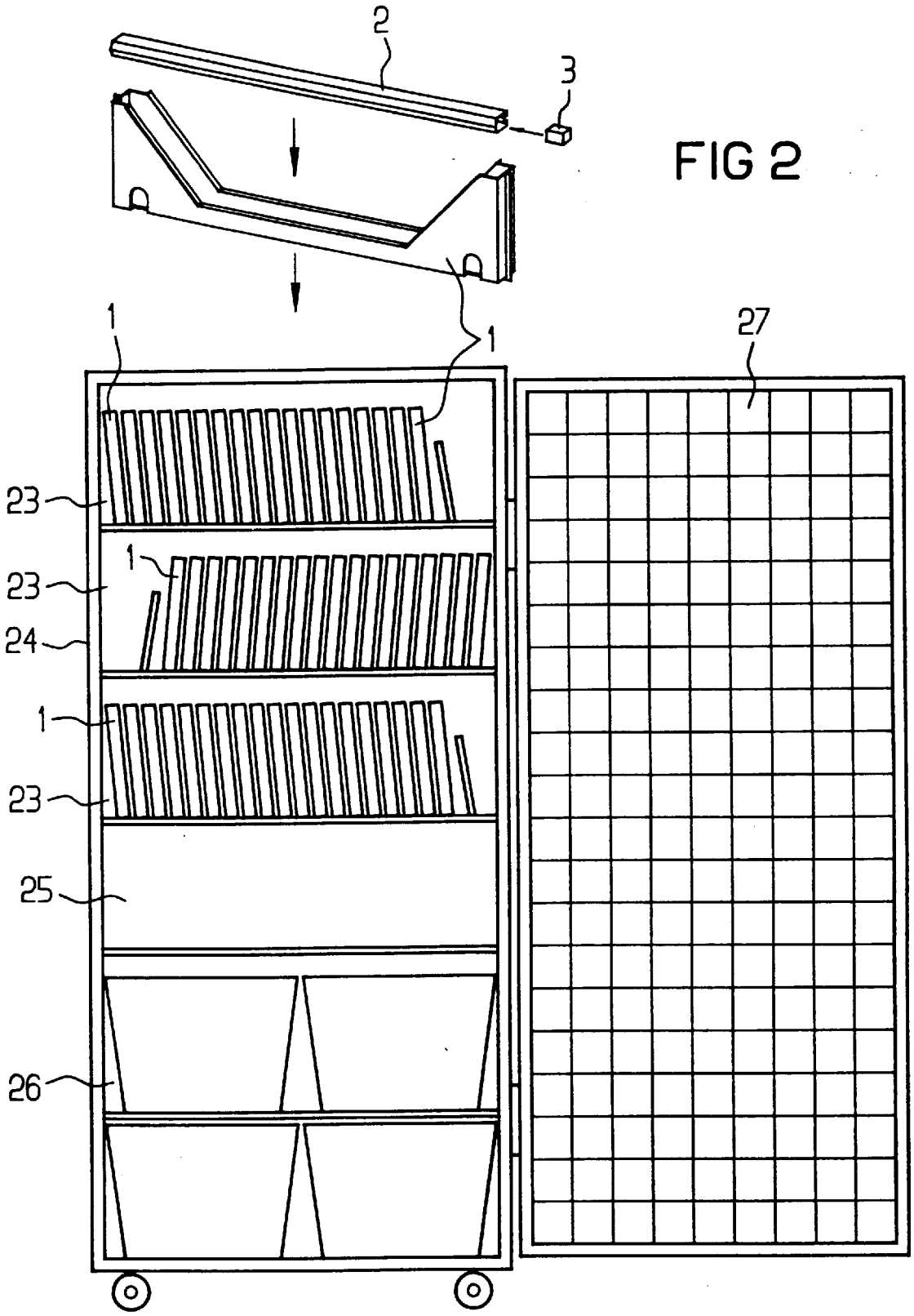
FIG. 2 illustrates a schematic view of the assembly of the cartridges and their arrangement in a transport vehicle.

As illustrated in FIG. 2, the cartridge 1 is fashioned from two half shells 11 and 12 which are molded from plastic and which respectively comprise a base side 14, a side wall 15 and two end walls 16 and 17. On the base side 14 as well as the ends 16 and 17, circumferential rims 18*a*, 18*b* and 18*c* are respectively integrally formed. The two half shells 11 and 12 are laid on one another and glued together with these circumferential rims. In addition, the rims 18*a* and 18*b* on the ends opposite one another serve for coding by means of their different widths. In this way, it is ensured that the cartridge is placed in the automatic placement machine with correct side orientation, and that the packed relay is processed in the automat with the correct orientation.

The side walls 15 of both half shells are approximately U-shaped or V-shaped in the center region or are cut out in some other way, thus saving material and weight. In addition, rims 19 are bent over and are integrally formed onto the upper edges of the side walls 15 in order to increase stability. One of the half shells, the half shell 11 in the present example, also has two openings 20 in its base region through which it is possible to press on the magazine stack from the base side in case of a possible jamming of the magazines. The molded half shells have for example a wall thickness of 2 mm, and the overall cartridge can for example, depending on the size of the relays, accept 10 to 20 bar magazines, each with about 20 to 30 relays. However, the numbers and size relationships can be adapted arbitrarily.

As already mentioned, in the packing of the relays, the relays 3 are respectively pushed into the open hollow space 21 of the respective bar magazine 2. This is then placed from above into the cartridge 1, without sealing the frontal sides. In this way, rod magazines 2 are stacked on one another until the cartridge is full. Two adhesive strips 22, which are placed over the end segments of the uppermost rod magazine 2 and are glued on both sides to the side walls 15 of the cartridge 1, then suffice as transport securing means. As shown in FIG. 2, the cartridges 1 filled in this way can be placed next to one another in magazine compartments 23 of a transport vehicle 24. This transport vehicle 24 can additionally comprise compartments 25 and 26 for accepting the empty cartridges or, respectively, rod magazines. It is closed with a grille door 27.

After arrival at the destination, the full cartridges 1 are removed from a transport vehicle 24, and the adhesive strips 22 are removed, so that the bar magazines 2 are freely accessible. The cartridge 1 then needs only to be turned by 180°, so that the open side points downward. The rod magazines 2 thus fall automatically into a transport apparatus, with which they are brought to their installation site in the automatic placement machine.

From the above description, it is apparent that the objects and advantages of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A transport container for relays disposed in elongated bar-shaped magazines, the magazines having an interior hollow space for accommodating the relays, each magazine further having openings disposed at opposing ends thereof for permitting the insertion and removal of relays, the transport container comprising:

a cartridge having a cuboid shape and comprising an open upper side for insertion of the magazines a closed bottom and two opposing end wall structures, the cartridge further comprising an interior space for mateably accommodating a plurality of magazines stacked lengthwise one on top of another, the end wall structures of the cartridge abuttingly engaging the open ends of the magazines to prevent release of relays from the magazines when the magazines are disposed lengthwise in the interior space of the cartridge, the cartridge further comprising two molded half shells connected at the closed bottom and two opposing end wall structures, each of said molded half shells further comprising a pair of end wall sections, each end wall section of each half shell engaging the end wall section of the other half shell to form one of said end wall structures of the cartridge, each end wall section of each half shell further comprising an outwardly projecting rim, each outwardly projecting rim of each molded half shells being connected the respective outwardly projecting rim of the other half shell.

2. The transport container of claim 1 wherein the cartridge is plastic.

3. The transport container of claim 1 wherein outwardly projecting rims of the of said molded half shells have a width, the widths of the rims disposed adjacent to one end wall structure of the cartridge being different than the widths of the rims disposed at the other opposing end wall structure of the cartridge thereby providing a means for differentiating one end of the cartridge from another end.

4. The transport container of claim 1 wherein each molded half-shell comprises a U-shaped side wall, each side wall being disposed between the opposing end wall structures and on opposing sides of the closed bottom.

5. The transport container of claim 5 wherein at least one of the side walls comprises an opening disposed adjacent to the closed bottom of the cartridge for providing access to the magazines.

6. A transport system for relays comprising:

a plurality of elongated bar-shaped magazines, the magazines comprising an interior hollow space for accommodating a plurality of relays, each magazine further comprising openings disposed at opposing ends thereof for permitting the insertion and removal of relays, the magazines being accommodated in a cuboid-shaped cartridge, the cartridge comprising an open upper side for insertion of the magazines, a closed bottom and two opposing end wall structures, the cartridge further comprising an interior space for mateably accommodating the plurality of magazines stacked lengthwise one on top of another, the end wall structures of the cartridge abuttingly engaging the open ends of the magazines to prevent release of relays from the magazines when the magazines are disposed lengthwise in the interior space of the cartridge.

7. The transport container of claim 6 wherein the cartridge and magazines are made of plastic.

8. The transport container of claim 6 wherein the cartridge further comprises two molded half shells connected at the closed bottom and two opposing end wall structures.

9. The transport container of claim 8 wherein each of said molded half shells further comprises a pair of end wall sections, each end wall section of each half shell engaging the end wall section of the other half shell to form one of said end wall structures of the cartridge, each end wall section of each half shell further comprising an outwardly projecting rim, each outwardly projecting rim of each molded half shells being connected the respective outwardly projecting rim of the other half shell.

10. The transport container of claim 9 wherein outwardly projecting rims of the of said molded half shells have a width, the widths of the rims disposed adjacent to one end wall structure of the cartridge being different than the widths of the rims disposed at the other opposing end wall structure of the cartridge thereby providing a means for differentiating one end of the cartridge from another end.

11. The transport container of claim 6 wherein the cartridge further comprises two opposing U-shaped side walls, each opposing side wall being disposed between the opposing end wall structures and on opposing sides of the closed bottom.

12. The transport container of claim 11 wherein at least one of the side walls comprises an opening disposed adjacent to the closed bottom of the cartridge for providing access to the magazines.

13. A transport system for relays comprising:

a moveable transport vehicle comprising a plurality of compartments, each compartment accommodating a plurality of cartridges, each cartridge accommodating a plurality of magazines, the magazines comprising an interior hollow space for accommodating a plurality of relays, each magazine further comprising openings disposed at opposing ends thereof for permitting the insertion and removal of relays, the magazines being accommodated in a cuboid-shaped cartridge, the cartridge comprising an open upper side for insertion of the magazines and two molded half shells connected to one another to form a closed bottom, two opposing end walls and two opposing side walls, the cartridge further comprising an interior space for mateably accommodating the plurality of magazines stacked lengthwise one on top of another, the end wall structures of the cartridge abuttingly engaging the open ends of the magazines to prevent release of relays from the magazines when the magazines are disposed lengthwise in the interior space of the cartridge.

14. The transport container of claim 13 wherein each of the cartridges and each of the magazines are made of plastic.

15. The transport container of claim 13 wherein each of said molded half shells of each of the cartridges further comprises a pair of end wall sections, each end wall section of each half shell engaging the end wall section of the other half shell to form one of said end wall structures of the cartridge, each end wall section of each half shell further comprising an outwardly projecting rim, each outwardly projecting rim of each molded half shells being connected the respective outwardly projecting rim of the other half shell.

16. The transport container of claim 15 wherein outwardly projecting rims of the of said molded half shells of each of the cartridges have a width, the widths of the rims disposed adjacent to one end wall structure of the cartridge being different than the widths of the rims disposed at the other opposing end wall structure of the cartridge thereby providing a means for differentiating one end of the cartridge from another end.

17. The transport container of claim 13 wherein the side walls of each of the cartridges are U-shaped.

18. The transport container of claim 17 wherein at least one of the side walls of each cartridge comprises an opening disposed adjacent to the closed bottom of the cartridge for providing access to the magazines disposed therein.

19. A transport container for relays disposed in elongated bar-shaped magazines, the magazines having an interior hollow space for accommodating the relays, each magazine further having openings disposed at opposing ends thereof for permitting the insertion and removal of relays, the transport container comprising:

a cartridge having a cuboid shape and comprising an open upper side for insertion of the magazines, a closed bottom and two opposing end wall structures, the cartridge further comprising an interior space for mateably accommodating a plurality of magazines stacked lengthwise one on top of another, the end wall structures of the cartridge abuttingly engaging the open ends of the magazines to prevent release of relays from the magazines when the magazines are disposed lengthwise in the interior space of the cartridge, the cartridge further comprising two opposing U-shaped side walls, each opposing side wall being disposed between the opposing end wall structures and on opposing sides of the closed bottom, and at least one of the side walls comprising an opening disposed adjacent to the closed bottom of the cartridge for providing access to the magazines.

20. The transport container of claim 19 wherein the cartridge is plastic.

21. The transport container of claim 19 wherein the cartridge further comprises two molded half shells connected at the closed bottom and two opposing end wall structures.

22. The transport container of claim 21 wherein each of said molded half shells further comprises a pair of end wall sections, each end wall section of each half shell engaging the end wall section of the other half shell to form one of said end wall structures of the cartridge, each end wall section of each half shell further comprising an outwardly projecting rim, each outwardly projecting rim of each molded half shells being connected the respective outwardly projecting rim of the other half shell.

23. The transport container of claim 22 wherein outwardly projecting rims of the of said molded half shells have a width, the widths of the rims disposed adjacent to one end wall structure of the cartridge being different than the widths of the rims disposed at the other opposing end wall structure of the cartridge thereby providing a means for differentiating one end of the cartridge from another end.

* * * * *